US012338058B2

(12) United States Patent
Coffey

(10) Patent No.: US 12,338,058 B2
(45) Date of Patent: Jun. 24, 2025

(54) WIPES BAG

(71) Applicant: PEEL PLASTIC PRODUCTS LTD, Brampton (CA)

(72) Inventor: John Matthew Arnold Coffey, Wasaga Beach (CA)

(73) Assignee: PEEL PLASTIC PRODUCTS LTD, Brampton (CA)

( * ) Notice: Subject to any disclaimer, the term of this patent is extended or adjusted under 35 U.S.C. 154(b) by 339 days.

(21) Appl. No.: 18/151,764

(22) Filed: Jan. 9, 2023

(65) Prior Publication Data

US 2023/0219738 A1 Jul. 13, 2023

Related U.S. Application Data

(60) Provisional application No. 63/298,736, filed on Jan. 12, 2022.

(51) Int. Cl.

| | |
|---|---|
| ***B65D 83/08*** | (2006.01) |
| ***B65D 33/24*** | (2006.01) |
| ***B65D 65/38*** | (2006.01) |

(52) U.S. Cl.

CPC ..... *B65D 83/0847* (2013.01); *B65D 33/243* (2013.01); *B65D 65/38* (2013.01); *B65D 2565/385* (2013.01)

(58) Field of Classification Search

CPC .... B65D 75/5838; B65D 31/10; B65D 31/16; B65D 33/2508; B65D 75/30; B65D 33/24; B65D 83/0805

See application file for complete search history.

(56) References Cited

U.S. PATENT DOCUMENTS

| | | | | |
|---|---|---|---|---|
| 3,198,228 A | | 8/1965 | Kakuji | |
| 4,002,264 A | * | 1/1977 | Marchesani | B65D 83/0847 206/390 |
| 4,004,687 A | * | 1/1977 | Boone | A47K 10/32 206/536 |
| 4,191,230 A | * | 3/1980 | Ausnit | B65D 33/2533 383/65 |
| 6,053,357 A | * | 4/2000 | Yoh | B65D 83/0805 221/63 |
| 6,079,878 A | * | 6/2000 | Yeager | B65D 33/2533 383/203 |
| 6,412,656 B1 | | 7/2002 | Placik | |

(Continued)

*Primary Examiner* — Ernesto A Grano

(74) *Attorney, Agent, or Firm* — Bhole IP Law; Anil Bhole; Chris Dynowski

(57) ABSTRACT

A package suitable for wipes. The package has a plastic film bag having a front face panel, a back face panel, an openable top and a closed bottom, a first sealing connection between first side edge regions of the respective panels at one side thereof, a second sealing connection between second side edge regions of the respective panels at the other side thereof, a third sealing connection between third edge regions of the respective panels at the bag bottom, a resealable closure integrated with the bag plastic film for sealingly closing the bag at closure regions of the panels near the bag top, and a plastic film membrane extending laterally across the bag. The membrane divides a bag interior into a contents storage chamber intermediate the bag closed bottom and the membrane, and an access chamber intermediate the resealable closure and the membrane.

24 Claims, 3 Drawing Sheets

(56) References Cited

U.S. PATENT DOCUMENTS

| | | | | |
|---|---|---|---|---|
| 6,554,134 | B1 * | 4/2003 | Guibert | B65D 83/0894 383/211 |
| 6,578,731 | B1 | 6/2003 | Lewis et al. | |
| 6,840,401 | B2 * | 1/2005 | Amundson | B65D 83/0805 221/56 |
| 6,981,590 | B1 * | 1/2006 | Ubel | B65D 33/1675 206/440 |
| 7,044,301 | B2 * | 5/2006 | Houze | B65D 77/26 206/440 |
| 8,220,651 | B2 * | 7/2012 | Norcom | B65D 31/06 220/495.08 |
| 10,875,701 | B2 | 12/2020 | McGhee et al. | |
| 2002/0096533 | A1 * | 7/2002 | Amundson | B65D 83/0805 221/63 |
| 2007/0023436 | A1 * | 2/2007 | Sierra-Gomez | B65D 77/003 220/270 |
| 2011/0031263 | A1 * | 2/2011 | Carrier | B65D 83/0894 221/45 |
| 2013/0004626 | A1 * | 1/2013 | Renders | B65D 33/02 493/213 |
| 2013/0114918 | A1 * | 5/2013 | Lyzenga | B65D 75/5827 383/203 |
| 2013/0121624 | A1 * | 5/2013 | Lyzenga | B65B 5/00 383/203 |
| 2013/0256169 | A1 * | 10/2013 | Bando | B65H 29/242 206/438 |

* cited by examiner

WIPES BAG

FIELD OF THE INVENTION

This invention relates to a bag or package for tissues

BACKGROUND

This invention relates to a bag or package for tissues, often referred to as wipes. Conventionally, wipes are used for cleaning small spills, smears, particulates, etc., from surfaces as varied as a person's hands or face, table and counter tops, small surface-soiled solid items, etc. Wipes are conventionally made of strong paper or non-woven fabric and are often impregnated with a solvent which aids in cleansing by dissolving or otherwise encouraging transfer of a deposited material from a soiled surface to the wipe. The solvent may be general purpose or may be tailored to a particular material to be removed from the surface: for example, to remove an oil deposit.

A problem with a wipe is that, if exposed to air, the solvent will evaporate from the wipe. If the exposure period is too long, the wipe may dry out and so be far less effective in removing deposited material from a surface.

SUMMARY OF THE INVENTION

According to one aspect of the invention, there is provided a package suitable for wipes comprising a plastic film bag having a front face panel, a back face panel, an openable top and a closed bottom, a first sealing connection between first side edge regions of the respective panels at one side thereof, a second sealing connection between second side edge regions of the respective panels at the other side thereof, a third sealing connection between third edge regions of the respective panels at the bag bottom, a resealable closure integrated with the bag plastic film for sealingly closing the bag at closure regions of the panels near the bag top, and a plastic film membrane extending laterally across the bag, wherein the membrane divides a bag interior into a contents storage chamber intermediate the bag closed bottom and the membrane, and an access chamber intermediate the resealable closure and the membrane.

Preferably, a membrane first edge region is sealed to the front panel, a membrane second edge region is sealed to the back panel, a membrane third edge region is sealed at the first sealing connection, and a membrane fourth edge region is sealed at the second sealing connection, thereby to seal the storage chamber from the access chamber at a perimeter of the membrane.

In another implementation for a 4-sided bag, each of the first and second sealing connections is an indirect sealing connection provided by a respective gusset panel extending between the front and back panels, the gusset panels each having a gusset first side edge region sealed at one of the front panel side edge regions to form a first seal, and a gusset second side edge region sealed at one of the back panel side edge regions to form a second seal. At the first seal, one part of the seal can be a direct seal between a first part of the gusset first side edge region and a first part of the front panel side edge region, while at another part of the first seal, the membrane can be folded, with opposed edge regions thereof extending from the fold being sealed between a second part of the gusset first side edge region and a second part of the front panel side edge region.

In another implementation, a 3-sided bag has one sealing connection of the form described previously for a 2-sided bag and the other sealing connection of the form described previously fora 4-sided bag.

BRIEF DESCRIPTION OF THE DRAWINGS

For simplicity and clarity of illustration, elements illustrated in the accompanying figure are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION

Figure 1:
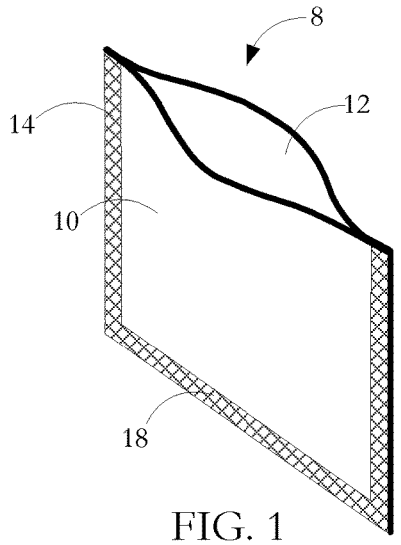
FIG. 1 is a perspective view from above and one side of a 2-sided bag suitable for application of the present invention.
Figure 3:
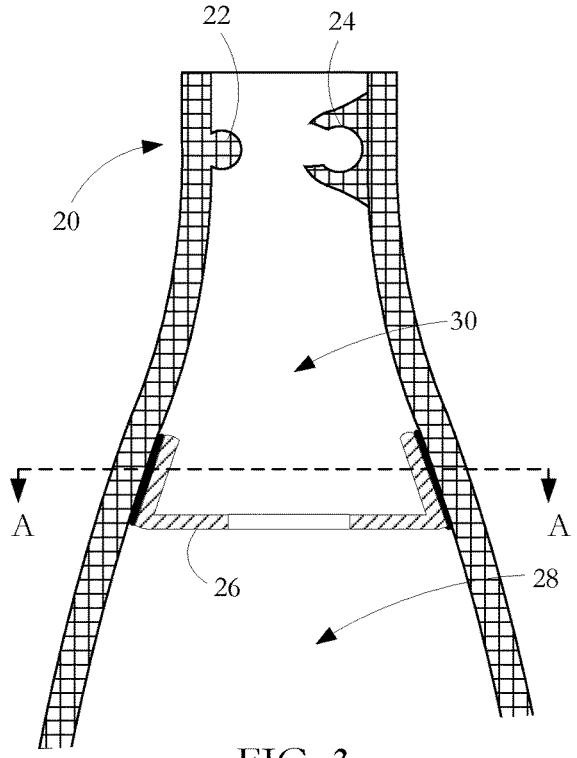
FIG. 3 is a vertical section through the bag of FIG. 2.
Figure 2:
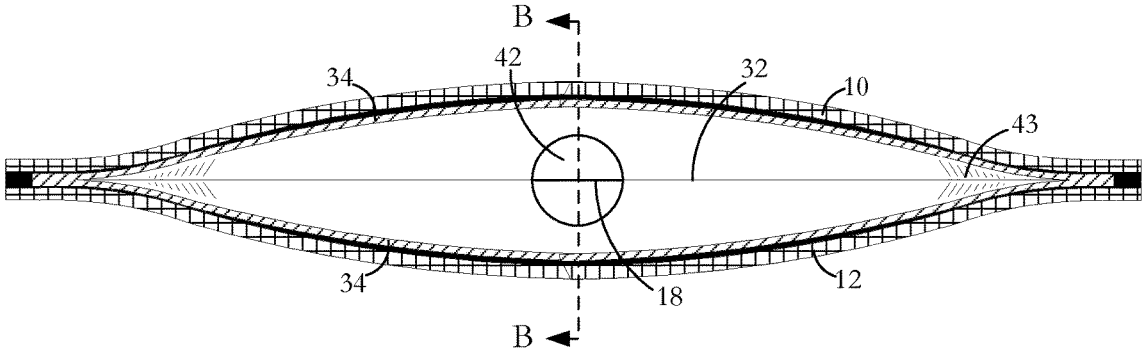
FIG. 2 is horizontal cross-section across the bag of FIG. 1 according to an embodiment of the invention.

FIG. 1 is a perspective view of a 2-sided bag 8 having a front panel 10 and a back panel 12. Edge portions 14 of the front panel and back panels are thermally welded together at each side of the bag and a bottom edge portion of the front panel is thermally welded to a bottom edge portion of the back panel at region 18. FIG. 2 shows a cross-section of the FIG. 1 bag viewed downwardly from a horizontal plane indicated by line A-A of FIG. 3, the plane crossing the upstanding bag near its top. FIG. 3 is a central vertical section viewed from one side of the bag from a vertical plane indicated by line B-B of FIG. 2. In an alternative embodiment of 2-sided bag (not shown), one edge region is formed between respective side edge regions of the front and back panels and the opposite side edge region is formed at a vertical fold in the plastic film material from which the bag is made.

As shown in FIG. 3, near the top of the bag, a resealable closure arrangement 20 is formed with the elements of the closure arrangement being integral with the front and side panels 10, 12. In the illustrated press-to-seal example, a rib 22 projects from the inside surface of one of the panels, and a channel formation 24 projects from the inside surface of the other panel, the rib 22 and the channel 24 being aligned with each other at the same height. The rib and the channel provide an interference fit such that when closing the bag from an open condition, the rib is pressed against the channel. With sufficient pressure being applied, the material of the rib 22 and the material defining the channel 24 are resiliently deformed to an extent allowing the rib to fully enter and be captured within the channel. Engagement of the rib in the channel provides both a seal and a mechanical closure. To open the closed bag, the panels 10, 12 are gripped and pulling away from each other, with sufficient force being applied that the rib is pulled out of the channel. Other known forms of temporarily sealing plastic bags can be used in the invention and the use of the term 'resealable closure' in this specification is intended to cover any of these, including so-called ziplock, slider seal, channel seal, zipper seal, press seal, press-to-close seal, grip seal, hook-to-hook and functionally equivalent terms.

Below the resealable closure, a membrane 26 extends across the bag to separate an interior lower contents chamber 28 of the bag from an interior upper access chamber 30 extending between the membrane 26 and the resealable closure 22.

Figure 4:
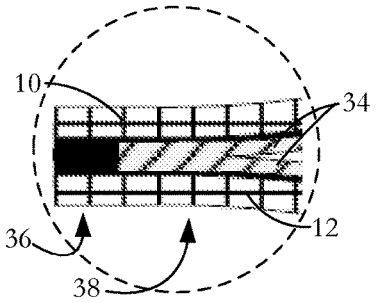
FIG. 4 shows a detail from the view of FIG. 3.

During manufacture of the bag, to install the membrane 26, a rectangular piece of plastic film is folded in half in the manner of a book and inserted, fold 32 down, between the front and back panels 10, 12. Edge margins 34 of the book 'pages' are sealed, using adhesive or thermal welding, respectively along the front and back panels 10, 12. Top and bottom end regions of the 'pages' are received between the edge regions of the front and back panels at each side of the bag so that, as shown in FIG. 4, outer parts 36 of bag edge seals are formed from two film layers—front panel 10 and back panel 12—and inner parts 38 of the bag edge seals are formed from four layers—front panel 10, edge regions of the first and second membrane 'pages' 34, and back panel 12. The membrane material is provided with enough gather, indicated at 43, to allow the bag to be expanded to an extent allowing the contents chamber 28 to accommodate the wipes and allowing the insertion of fingers or hand into the access chamber 30 for withdrawal of wipes.

Figure 8:
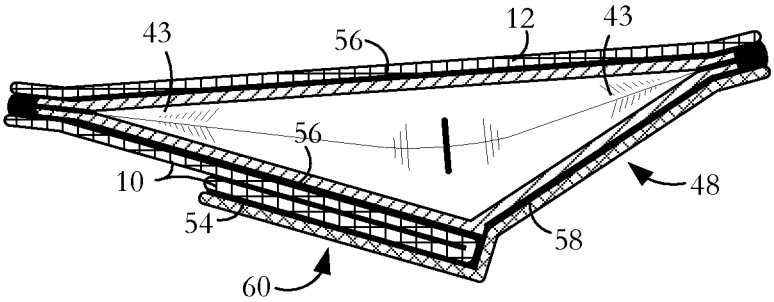
FIG. 8 is horizontal cross-section across a 3-sided bag according to an embodiment of the invention.

Located at the center of the membrane is an aperture 42 through which wipes can be drawn successively from the contents chamber through the access chamber and out of the bag. In the embodiment illustrated in FIGS. 2 and 3, the aperture is a circular hole. The hole can be a different shape or can be of slit form as shown in FIG. 8. In another embodiment (not shown), the membrane initially has an area of weakness which is breached to form an aperture when the bag is first used to give access subsequently to the stored wipes.

Depending on the nature of wipes to be contained in the bag and on the desired level of resistance to the extraction of wipes, the plastic film material of the membrane can be either stiffer than the plastic film of the rest of the bag, or can be more flexible than the bag film material. The combination of membrane stiffness and membrane aperture size and configuration are tailored to the nature of the wipes to be dispensed from the bag.

For a series of wipes having adjacent wipes secured to each other, such a combination is adopted that presents sufficient drag that, as a leading wipe is pulled from the package, the connected next-adjacent wipe is itself pulled to a position where a leading part thereof projects through the aperture. At a critical stage, the drag caused by the aperture overcomes the connecting force between the leading wipe and the next adjacent wipe, causing the two wipes to be torn apart. This leaves the leading wipe in separated condition ready for use, and the next adjacent wipe with its leading part projecting above the aperture ready for a user to grip and pull it from the bag. For a series of wipes in which adjacent wipes are separate from each other but are loosely connected by appropriate folding, wrapping or overlapping, a combination of membrane stiffness and aperture configuration presenting a lower drag is adopted.

In one embodiment, the membrane is made from a first plastic film material different from the plastic film from which the main part of the bag is made. The materials can differ in any one or more of composition, stiffness, printability, lateral or punctuation strength, weight per unit area, transparency, thermal weldability, etc. This admits of selection of a membrane material having properties suited to the membrane function and a bag material having properties suited to the bag function. For example, for good on-shelf bag appearance, bag material is used that has a sufficiently high stiffness that the bag can stand in an upright condition. To effectively contain wipes or other contents, a bag material is used having a sufficiently high tensile strength. In contrast, depending on operational circumstances, an optimal membrane material may have a lower stiffness and/or a lower tensile strength. The membrane film might also be chosen to accept printing that can be viewed through the upper end of the bag when the bag is in an open condition. In another embodiment, the membrane is made of clear plastic film so that the contents can be seen through the bag opening. Alternatively, the membrane is of the same composition as the material of the rest of the bag: for example, to facilitate recycling.

Figure 5:
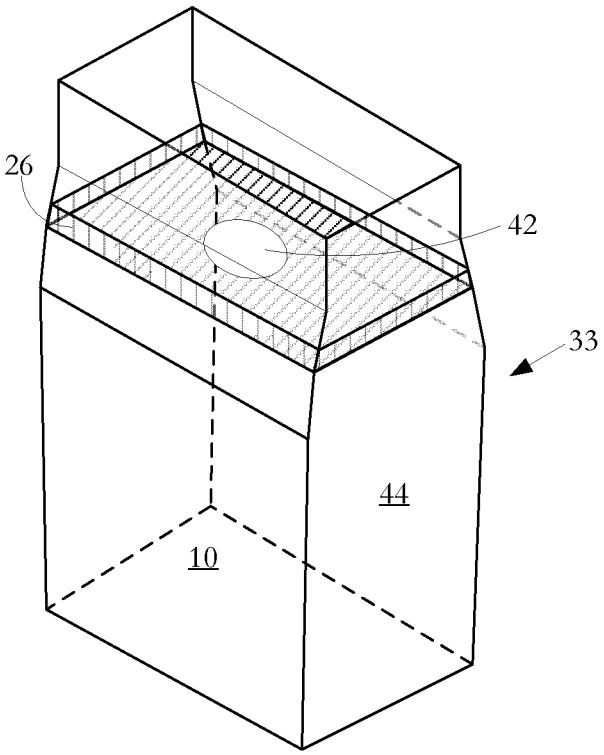
FIG. 5 is a perspective phantom view from above and one side of a 4-sided bag according to another embodiment of the invention.
Figure 6:
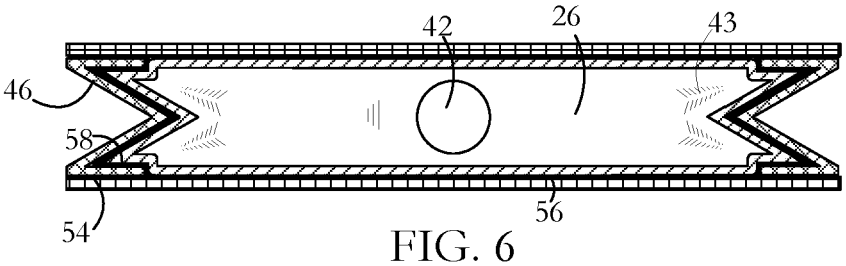
FIG. 6 is horizontal cross-section across an alternative form of 4-sided bag according to a further embodiment of the invention.

In another embodiment of the invention, for a 4-sided bag 33, sealing connections between the front and back panels are indirect connections provided either by ungusseted panels 44 (FIG. 5) or by gusseted panels 46 (FIG. 6). In a further implementation, such as that shown in FIG. 8, a 3-sided bag 35 has one direct sealing connection of the form described previously for the 2-sided bag and one indirect sealing connection provided by a panel 48, gusseted or otherwise, as used in a 4-sided bag. As shown in FIG. 5, in contrast with the bottom formation of the bag of FIG. 1, a base panel interconnects the front and back panels 10, 12 and interconnects the side panels 44.

In all cases, either a seal between previously separate panel margins, or a fold in the bag material, forms a junction region between adjoining panels. Regardless of whether the bag is 2-, 3- or 4 sided, gusseted or non-gusseted, with base panel or without, membrane 26 divides the interior of the bag into a contents chamber 28 and an access chamber 30 with margins of the membrane material sealed against the bag panels to separate the two chambers. As illustrated in the figures, membrane margins 34 are turned up where they seal against a particular panel, or may be turned down.

Figure 7:
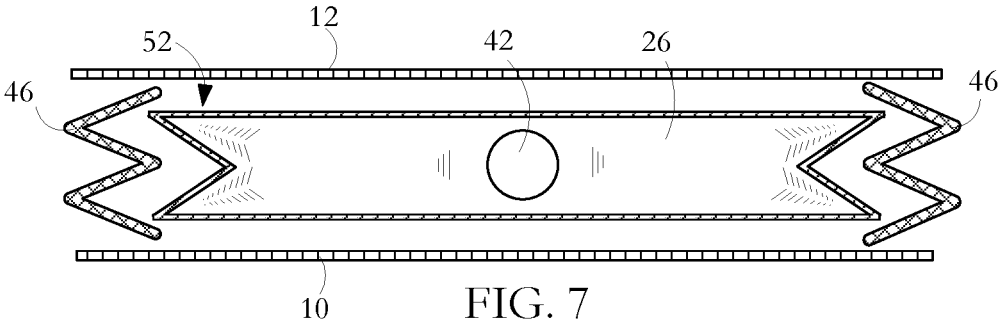
FIG. 7 is a view corresponding to FIG. 6 but showing the bag in the course of manufacture.

An exemplary arrangement for a 4-sided gusseted bag is shown in stylized cross-section in FIG. 7. FIG. 6 shows a corresponding view of the separate constituent bag elements before they are assembled and sealed together to form the finished bag. In the course of manufacture, gusset panels 46 are each folded into an M-form and corresponding M-form folds 52 are made by gathering the membrane material. Gusset-to panel seals 54, membrane-to-panel seals 56, and gusset-to-membrane seals 58 are made where indicated in FIG. 7. Depending on the nature of the film materials at a particular seal and on other product and manufacturing necessities, the seal may be made using either thermal welding or adhesive.

Figure 9:
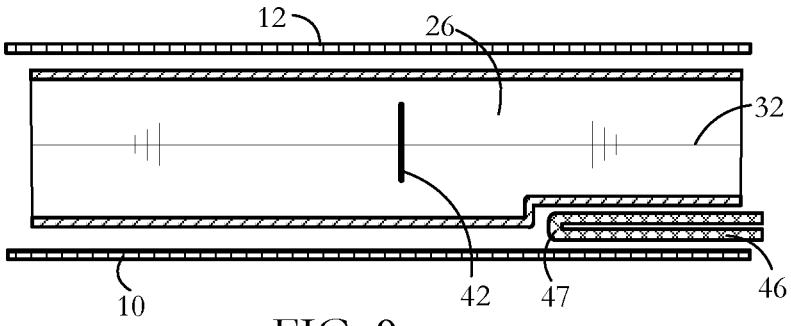
FIGS. 9 and 10 are views corresponding to FIG. 6 but showing the bag in successive stages in the course of its manufacture.
Figure 10:
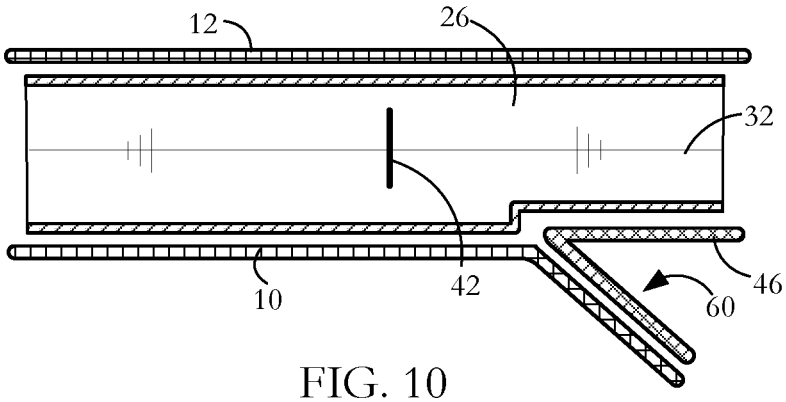

An exemplary arrangement for a 3-sided gusseted bag is shown in stylized cross-section in FIG. 8. FIGS. 9 and 10 shows corresponding views of the separate constituent bag elements before they are assembled and sealed together to form the finished bag. In the course of such assembly, gusset panel 46 is folded and fold 47 is inserted laterally between the front and back panels 10, 12 and close to the front panel 10 at the right-hand end of the panels. Membrane 26 is folded downwardly between the front and back panels at a desired height and with the right-hand end of the folded membrane located between the gusset 46 and the back panel 12. Seals are then made as shown by black layers in FIG. 8 with a bag piece formed between a part of the gusset 46 and an adjoining part of the front panel 10 being bent back out of the way and attached to an adjacent part of the front panel.

In use, a bag according to the invention can be opened and closed at the resealable closure. When the bag is opened, a wipe can be taken out of the bag by withdrawing it through the aperture and the access chamber and out of the top of the bag. Even though the aperture may remain open after removing the wipe from the bag, this is not a disadvantage because sealing closure of the bag is provided by the resealable closure.

The use of the term 'plastic film' in this specification is intended to cover any film or sheet material made of polyethylene, polypropylene, polyester, nylon, polyvinyl chloride or the like. Such materials can be single ply, multi-ply (including mixed ply) with plies thermally welded or adhered together. Such materials include bioplastics, biodegradable plastics and recyclable plastics.

A bag embodying the invention, while particularly suited to containing and preserving moist wipes, is also well suited to containing and preserving dry wipes and other materials. In all cases, the bag is closed and sealed to provide one level of protection, while the membrane provides the contents with a second level of protection even when the bag is opened at the resealable closure.

The invention claimed is:

1. A package for wipes comprising a plastic film bag having a front face panel, a back face panel, an open top and a closed bottom, a first sealing connection between first side edge regions of the respective panels at one side thereof, a second sealing connection between second side edge regions of the respective panels at the other side thereof, a third sealing connection between third edge regions of the respective panels at the bag bottom, a resealable closure integrated with the bag plastic film for sealingly closing the bag at closure regions of the panels near the bag top, a plastic film membrane extending laterally across the bag and dividing a bag interior into a contents storage chamber intermediate the bag closed bottom and the membrane, and an access chamber intermediate the resealable closure and the membrane;

wherein a membrane first edge region is sealed to the front panel, a membrane second edge region is sealed to the back panel, a membrane third edge region is sealed to the first sealing connection, and a membrane fourth edge region is sealed to the second sealing connection, thereby to seal the storage chamber from the access chamber at a perimeter of the membrane;

wherein at least one of the sealing connections is a direct seal between a first part of one of the front panel first side edge regions and a first part of one of the back panel side edge regions, and, at another part of said at least one sealing connection, the membrane is folded, and opposed edge regions of the membrane extending from the fold are sealed between a second part of the front panel first side edge region and a second part of the back panel first side edge region.

2. The package as claimed in claim 1, wherein one of the first and second sealing connections is an indirect sealing connection provided by a gusset panel extending between the front and back panels, the gusset panel having a gusset first side edge region sealed at one of the front panel side edge regions to form a first seal, and a gusset second side edge region sealed at one of the back panel side edge regions to form a second seal.

3. The package as claimed in claim 2, wherein at the first seal, one part of the seal is a direct seal between a first part of the gusset first side edge region and a first part of the front panel side edge region, and at another part of the first seal, the membrane is folded, and opposed edge regions of the membrane extending from the fold are sealed between a second part of the gusset first side edge region and a second part of the front panel side edge region.

4. The package as claimed in claim 1, wherein the plastic film of the membrane is stiffer than the plastic film of the rest of the bag.

5. The package as claimed in claim 1, wherein the membrane has a formation therein facilitating extraction of the contents from the storage chamber through the access chamber and out of the bag top when the resealable closure is in an open condition.

6. The package as claimed in claim 5, wherein the formation is an aperture.

7. The package as claimed in claim 6, wherein the aperture is one of a hole and a slit.

8. The package as claimed in claim 5, wherein the formation is a weakened an area of the membrane.

9. The package as claimed in claim 1, wherein the membrane is made from a first material having a least one property different from a second material of which the rest of the bag is made.

10. The package as claimed in claim 9, wherein the property is one of composition, stiffness, printability, strength, weight per unit area, transparency and thermal weldability.

11. The package as claimed in claim 1, wherein the material of the membrane has the same composition as the material of the material of the rest of the bag.

12. The package as claimed in claim 11, wherein the composition is recyclable polyethylene.

13. A package for wipes comprising a plastic film bag having a front face panel, a back face panel, an open top and a closed bottom, a first sealing connection between first side edge regions of the respective panels at one side thereof, a second sealing connection between second side edge regions of the respective panels at the other side thereof, a third sealing connection between third edge regions of the respective panels at the bag bottom, a resealable closure integrated with the bag plastic film for sealingly closing the bag at closure regions of the panels near the bag top, a plastic film membrane extending laterally across the bag and dividing a bag interior into a contents storage chamber intermediate the bag closed bottom and the membrane, and an access chamber intermediate the resealable closure and the membrane;

wherein one of the first and second sealing connections is an indirect sealing connection provided by a gusset panel extending between the front and back panels, the gusset panel having a gusset first side edge region sealed at one of the front panel side edge regions to form a first seal, and a gusset second side edge region sealed at one of the back panel side edge regions to form a second seal;

wherein at the first seal, one part of the seal is a direct seal between a first part of the gusset first side edge region and a first part of the front panel side edge region, and at another part of the first seal, the membrane is folded, and opposed edge regions of the membrane extending from the fold are sealed between a second part of the gusset first side edge region and a second part of the front panel side edge region.

14. The package as claimed in claim 13, wherein a membrane first edge region is sealed to the front panel, a membrane second edge region is sealed to the back panel, a membrane third edge region is sealed to the first sealing connection, and a membrane fourth edge region is sealed to the second sealing connection, thereby to seal the storage chamber from the access chamber at a perimeter of the membrane.

15. The package as claimed in claim 14, wherein at least one of the sealing connections is a direct seal between a first part of one of the front panel first side edge regions and a first part of one of the back panel side edge regions, and, at another part of said at least one sealing connection, the membrane is folded, and opposed edge regions of the membrane extending from the fold are sealed between a second part of the front panel first side edge region and a second part of the back panel first side edge region.

16. The package as claimed in claim 13, wherein the plastic film of the membrane is stiffer than the plastic film of the rest of the bag.

17. The package as claimed in claim 13, wherein the membrane has a formation therein facilitating extraction of the contents from the storage chamber through the access chamber and out of the bag top when the resealable closure is in an open condition.

18. The package as claimed in claim 17, wherein the formation is an aperture.

19. The package as claimed in claim 18, wherein the aperture is one of a hole and a slit.

20. The package as claimed in claim 17, wherein the formation is a weakened an area of the membrane.

21. The package as claimed in claim 13, wherein the membrane is made from a first material having a least one property different from a second material of which the rest of the bag is made.

22. The package as claimed in claim 21, wherein the property is one of composition, stiffness, printability, strength, weight per unit area, transparency and thermal weldability.

23. The package as claimed in claim 13, wherein the material of the membrane has the same composition as the material of the material of the rest of the bag.

24. The package as claimed in claim 23, wherein the composition is recyclable polyethylene.

* * * * *